United States Patent [19]

Nakano et al.

[11] Patent Number: 4,701,734

[45] Date of Patent: Oct. 20, 1987

[54] HINGE TYPE RELAY

[75] Inventors: Sadao Nakano, Yokohama; Shigeru Inaba, Zama, both of Japan

[73] Assignee: Niles Parts Co., Ltd., Tokyo, Japan

[21] Appl. No.: 844,880

[22] Filed: Mar. 27, 1986

[51] Int. Cl.[4] ..... H01H 67/02

[52] U.S. Cl. ..... 335/128; 335/270; 335/275

[58] Field of Search ..... 335/124, 128, 270, 275, 335/276, 279

[56] References Cited

U.S. PATENT DOCUMENTS

| | | | |
|---|---|---|---|
| 3,958,200 | 5/1976 | Mally | 335/275 |
| 4,460,881 | 7/1984 | Meister et al. | 335/128 |

FOREIGN PATENT DOCUMENTS

| | | | |
|---|---|---|---|
| 2614926 | 10/1977 | Fed. Rep. of Germany | 335/128 |
| 59-105749 | 7/1984 | Japan | 335/128 |

*Primary Examiner*—George Harris

*Attorney, Agent, or Firm*—Vorys, Sater, Seymour and Pease

[57] ABSTRACT

In an armature of a hinge type relay having a movable contact elastically at one side, a rocking cardinal piece which is bendingly formed to the lower direction is provided at another side of the armature. A fulcrum piece which rockingly supports the rocking cardinal piece is provided at the lower portion of the upper bent portion of the yoke which supports the armature. The armature rocks due to the energization of the electromagnet, premitting the rocking cardinal piece to be a base point and the movable contact and the fixed contact separate or contact each other causing a relative wiping action. Foreign matter such as oxides, dusts and the like which generate at the contact points, and which cause a bad contact, are thereby removed, keeping the contacts continually clean.

25 Claims, 11 Drawing Figures

HINGE TYPE RELAY

BACKGROUND OF THE INVENTION

1. Field of the Invention

This invention relates to hinge type relays. More particularly, this invention relates to hinge type relays wherein a fixed contact is wiped by a moving contact when both contacts separate or contact each other.

2. Description of the Prior Art

FIG. 1 illustrates an example of a conventional prior art hinge type relay wherein an armature 1 is rockingly inserted and supported at an upper end portion 3*a* of an upper bent portion of a yoke 3 to which an electromagnet 2 is secured. The upper end portion 3*a* of the yoke 3 defines a fulcrum by the excitation or de-energizing action of the electromagnet 2. A movable contact 5 of a movable contact plate 4 fixed on the armature is adapted to contact or separate only with the fixed contact 6 as shown by the phantom line in FIG. 1, and both contacts 5 and 6 do not wipe.

The movable and fixed contacts in the conventional hinge type relay, therefore, only to contact and separate and both contacts do not wipe or slide relative to one another. Accordingly, there is no self-cleaning function at both contact points and therefore a bad contact frequently occurs due to the presence on the contacts of foreign matter such as oxides, sulfides, carbonized materials or dust and to the abrasion which occurs at the contact portion due to use over a long period of time.

SUMMARY OF THE INVENTION

This invention provides a hinge type relay for which both contacts wipe against each other when they contact or separate thereby remedying the disadvantages of the conventional hinge type relay.

A first object of the invention is to provide a hinge type relay having a self-cleaning ability and a low electric resistance contact by always keeping the contact portion clean.

A second object is to provide a hinge type relay which does not cause any trouble while in use over a long period of time and which is very durable.

A third object is to provide a hinge type relay which is simple of construction and easy to manufacture.

A fourth object is to provide a hinge type relay wherein the armature does not easily fall off of the yoke and which is resistant to vibration.

These and other objects are attained by providing the device with a rocking cardinal piece formed to bend downwardly at a portion of the armature having a hinge type relay and having a movable contact elastically connected at another portion thereof and further including a fulcrum piece which latchingly supports the rocking cardinal piece of the armature rockingly at the lower part of the upper bend portion of the yoke which supports said armature.

BRIEF DESCRIPTION OF THE DRAWINGS

Various other objects, features and attendant advantages of the present invention will be more fully appreciated from the following detailed description of the invention and the drawings wherein like reference characters designate like or corresponding parts throughout the drawings, and wherein.

DETAILED DESCRIPTION OF THE PREFERRED EMBODIMENTS

Figure 1:
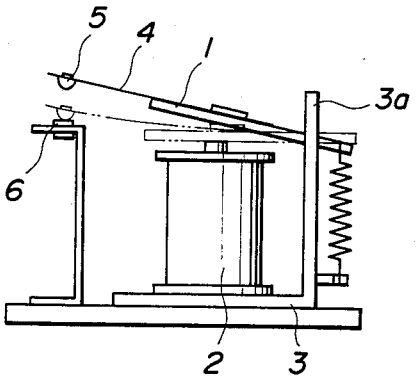
FIG. 1 is an elevational view of a conventional hinge type relay.
Figure 2:
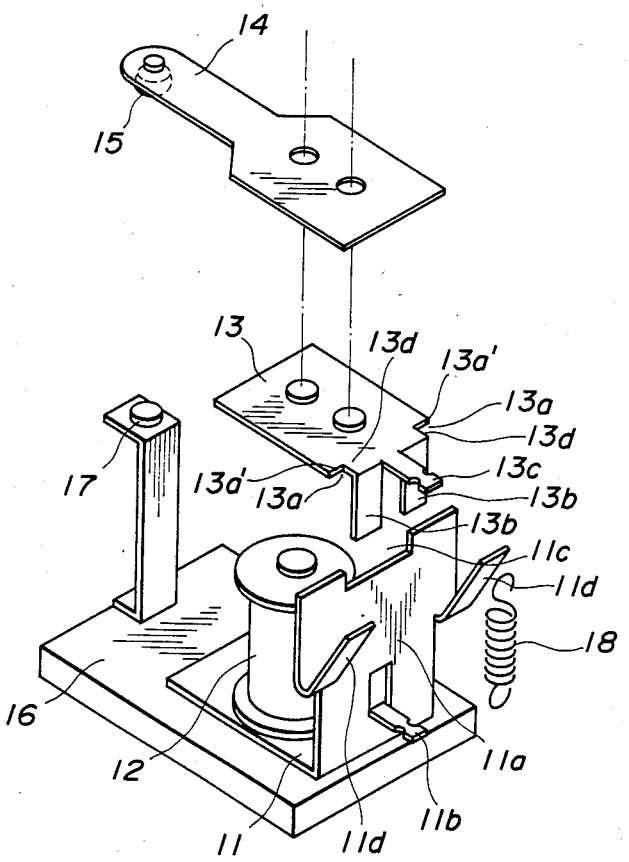
FIG. 2 is an exploded perspective view of an embodiment of the present invention.
Figure 3:
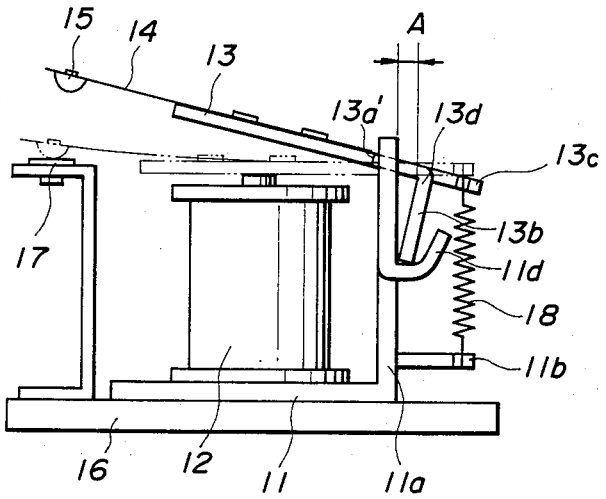
FIG. 3 is an elevational view thereof.
Figure 4:
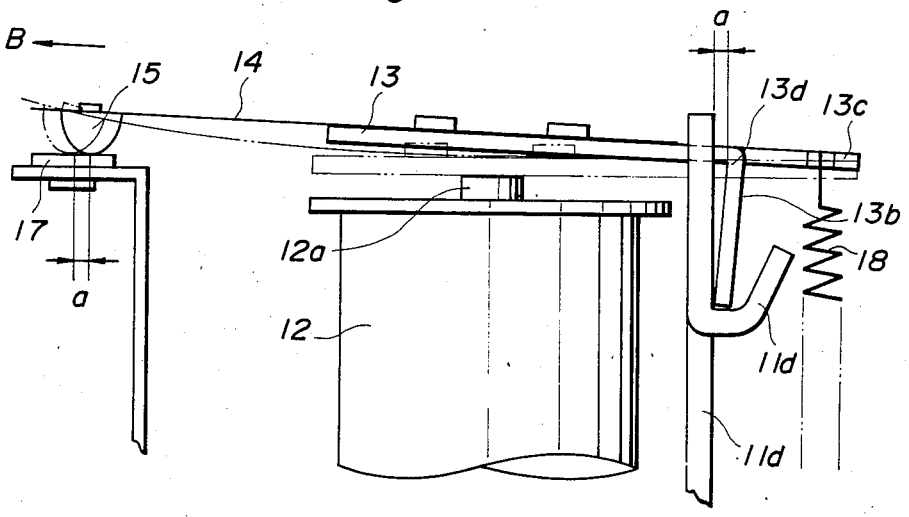
FIG. 4 is an enlarged fragmentary view of the upper portion of the embodiment of FIG. 1 illustrating the operation thereof.

FIGS. 2, 3 and 4 illustrate a first embodiment of a hinge type relay according to this invention. A yoke 11 is provided to which an electromagnet 12 is fixed. The yoke 11 includes an upper bent portion 11*a* formed to bend upwardly and a projection 11*b* to which a spring is latched at the lower portion thereof. At the lower side of the upper bent portion 11*a*, the arms 11*d* are bent upwardly and a cutaway portion 11*c* is provided at the upper end portion of the upper bent portion 11*a*.

An armature 13 is provided and includes a cutaway portion 13*a* for movably inserting the cutaway portion 11*c* of the yoke 11. In addition, a rocking cardinal piece 13*b* is provided bendingly formed and including a projection 13*c* for latching the spring 18 at the lower portion of the armature. A movable flexible contact plate 14 is provided to which a movable contact 15 is secured at one side. The movable contact plate is secured to the upper surface of the armature.

Accordingly, the armature 13 is provided with the movable contact 15 elastically at one side. The rocking cardinal piece 13*b* is formed so as to be able to bend downwardly. The rocking cardinal piece 13*b* is placed on the arm 11*d* of the yoke 11 to allow rocking, and armature 13 is supported at the lower part of the upper bend portion 11*a* of the yoke 11 to allow a rocking action. The arm 11*d* of the yoke 11 forms a fulcrum piece which rockingly supports rocking cardinal piece 13*b* of the armature 13.

A relay base 16 secures the yoke 11 and the electromagnet 12. A fixed contact 17 is mounted to relay base 16 and to the movable contact 15. A spring 18 is provided, one end of which is latched to the projection 11*b* for latching the spring to the yoke 11, and the other end of which is latched to a projection 13*c* for latching the spring to the armature 13, thereby being tensioned between projections 11*b* and 13*c*.

Accordingly, when the electromagnet 12 is not excited, the armature 13 is, as shown by the solid line in FIG. 3, allowed to slant to the right of the figure allowing the lower end portion of the rocking cardinal piece 13*b* of the armature 13 to be a fulcrum portion due to the tension of the spring 18. The slanted position of the armature is latched by the vertical surface 13*a*′ of a cutaway portion 13*a* in the armature 13 and thereby abuts against the upper inner surface of the bent portion 11*a* of the yoke 11. Further, referring to the slanted position to the right of the armature 13, the projection 13*c* for latching the spring is positioned at the lower portion and the movable contact 15 of the movable contact plate 14 fixed at the upper surface thereof is positioned at the upper portion, the movable contact 15 is spaced above the fixed contact 17. Further, at this time the inner surface of the shoulder 13*d* of the armature 13 which is the bent portion of the rocking cardinal piece 13*b* of the armature 13 protrudes outwardly from the upper bent portion 11*a* of the yoke 11 by a projected distance A.

When the electromagnet 12 is excited, the armature 13 is attracted to the electromagnet 12 and is rocked to the left of the figure letting the lower end portion of the rocking cardinal piece 13*b* of the armature to the fulcrum against the tension of the spring 18, thereby being attracted to the iron core of the electromagnet 12. Thus, when the armature 13 is rocked to the left of the figure as shown by the phantom line in FIG. 3, the movable contact 15 of the movable contact plate 14 contacts with the fixed contact 17, whereby a switch action is created to close an electric circuit (not shown) connected with both contacts 15 and 17. Further, the shoulder 13*d* of the armature moves to the inner direction of the upper bent portion 11*a* in the yoke 11 by the rocking of the armature, which causes the projected distance A of the inner portion thereof to slowly shorten. The projected distance disappears when the armature is rocked to its horizontal position. Accordingly, the armature 13 moves to the left of the figure by projected distance A. In other words, it moves transversely to inner direction of the upper bent portion 11*a* of the yoke 11.

The transverse movement which occurs together with the rocking of the armature 13 is illustrated in FIG. 4 in detail. The armature 13 shown by a solid line in the figure indicates a rocking condition when the movable contact 15 of the movable contact plate 14 contacts with the fixed contact 17. At this time, the inner surface of the shoulder 13*d* of the armature 13 protrudes outward of the upper bent portion 11*a* of the yoke 11 by a slightly shorter projected distance a than the initial distance A. Then, when the rocking of the armature 13 continues to its horizontal state and a portion of the armature is attracted to and contacts the iron core 12*a* of the electromagnet 12, the armature 13 moves to the left or the transverse direction of the fixed contact 17 as shown by the phantom line in the figure. The inner surface of a stopper 13*b* of the armature 13 contacts the outer surface of the upper bent portion 11*a* of the yoke 11, and thus the projected distance a of the shoulder 13*d* of the armature 13 disappears. Accordingly, the movable contact 15 slides in the direction B as shown by the arrow in FIG. 4 by the above projected distance a on the fixed contact.

Further, in order to created a sufficient contact pressure, the movable contact plate 14 may be elastically deformed at the time of contact. The movable contact 15 moves in a reverse direction against the direction shown by the arrow B due to the elastic deformation of the movable contact plate 14, but the distance the movable contact 15 moves according to the deformation of the movable plate 15 is very small and thus the movement distance a relative to the direction B shown by an arrow is inconsequential and can be ignored.

Then, when the electromagnet is deenergized, the armature 13 is returned automatically and rockingly to its original state letting the lower end portion of the rocking cardinal piece 13*b* of the armature to be the fulcrum by the elastic stability of the spring 18 and the movable contact 15 moves upwardly from the fixed contact 17, whereby the electric current connected with both contacts 15 and 17 defines an open circuit. Further, the movable contact 15 slides in the reverse direction against the direction B on the fixed contact 17 by movement distance a and then separates from the fixed contact 17 and the shoulder 13*d* of the armature 13 protrudes outward of the upper bent portion 11*a* of the yoke by projected distance A, whereby the armature 13 returns to its original slanting state.

Figure 5A:
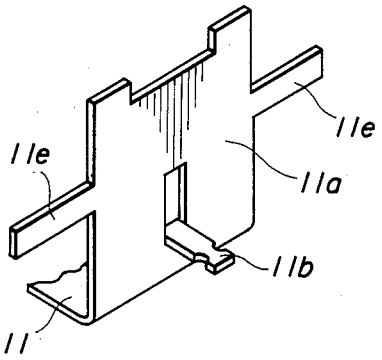
FIG. 5(*a*), (i b), and (*c*) are perspective views of the yoke of FIG. 2 illustrating the methods of forming the arms.
Figure 5B:
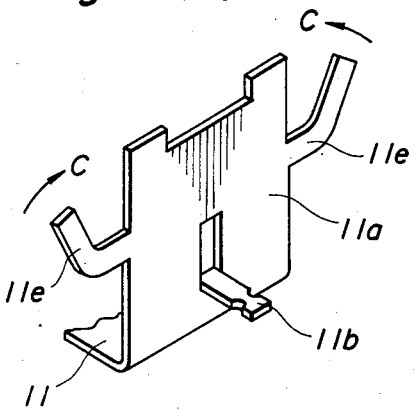
Figure 5C:
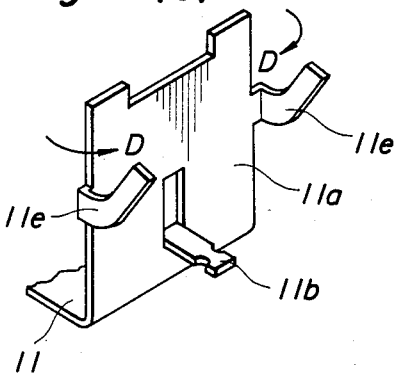

Further, although the arm 11*d* of the hinge type relay is formed upwards from the lower side of the upper bent portion 11*a* of the yoke, the arm 11*d* may also be upwardly formed as shown in FIG. 5. In other words, the arm 11*d* of the hinge type relay can be formed by forming a projection piece 11*e* at the lower side of the upper bent portion 11*a* of the yoke as shown in FIG. 5(*a*), twisting the projection piece 11*e* in the upper direction C as shown in FIG. 5(*b*), and then bending the projection piece 11*e* to the outward direction D as shown in FIG. 5(*c*).

Figure 6:
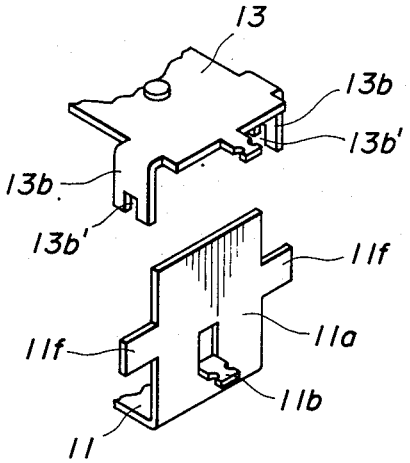
FIG. 6 is a perspective view of the yoke and armature of a second embodiment of the invention.

FIG. 6 shows a second embodiment of the hinge type relay according to this invention, in which the construction of the latching portion of the armature 13 with the yoke 11 is modified. A cutaway portion 13*b*′ is provided at the top end portion of the rocking cardinal piece 13*b* bendingly formed at the lower part of another portion of armature 13 having a movable contact elastically at one side. A projection 11*f* which latches with a cutaway portion 13*b*′ of the rocking cardinal piece 13*b* of the armature is provided at the lower side of the upper bent portion 11*a* of the yoke 11, thereby rockingly supporting the armature 13 to the projection 11. Accordingly, the projection 11*f* of the yoke 11 forms a fulcrum piece which rockingly supports the rocking cardinal piece 13*b* of the armature 13.

Figure 7:
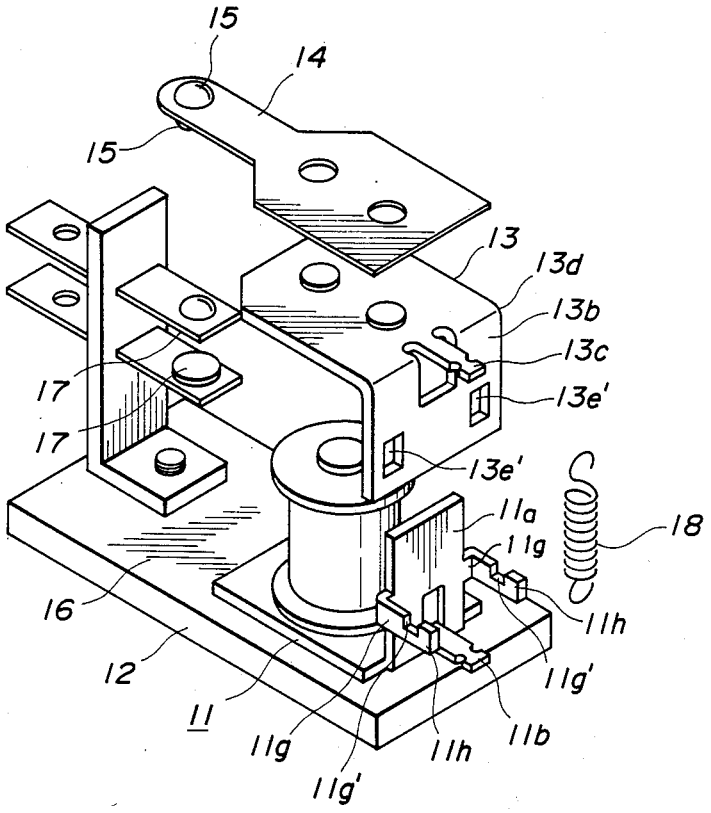
FIG. 7 is an exploded perspective of a third embodiment of the invention.
Figure 8:
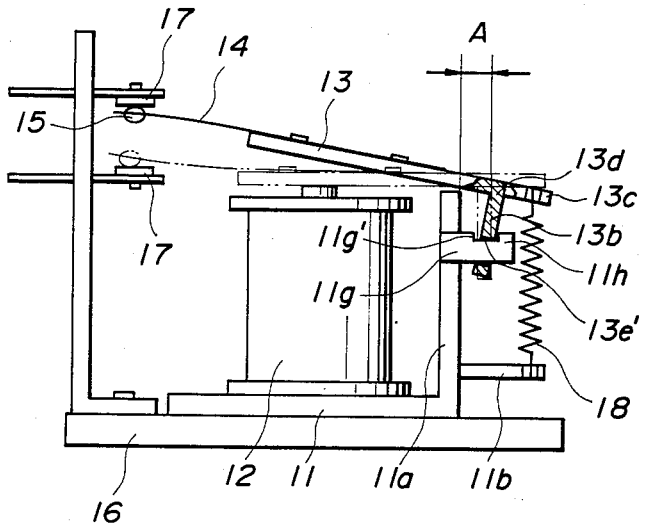
FIG. 8 is a side elevational view of the embodiment of FIG. 7.

A third embodiment of the present invention is illustrated in FIG. 7 and FIG. 8. At the lower portion of the upper bent portion 11*a* of the yoke 11, supporting pieces 11*g* are formed bending from both the left and right sides and the supporting pieces 11*g* are further provided with cutaway portions 11*g*′ respectively at the upper surfaces thereof. The cutaway portion 11*g*′ of the supporting pieces 11*g* forms a stopper 11*h* which protrudes upward at the outer portion of the cutaway portion 11*g*′. At the lower portion of the rocking cardinal piece 13*b* bendingly formed at the lower part of the armature 13, latching holes 13*e*′ are perforated therethrough to rockingly latch with the cutaway 11*g*′ of the supporting piece 11*g* of the yoke 11. Further, at the relay base 16 upper and lower fixed contacts 17 are arranged correspondingly to the upper and lower portions of the movable contacts 15 of the movable sheet 14.

Accordingly, the armature 13 rocks permitting the inserting portion of the latching hole 13*e* of the rocking cardinal piece 13*b* and the cutaway portion 11*g*′ of the supporting piece 11*g* of the yoke 11 to be a base point according to the energizing of the electromagnet 12, thereby causing the contact or separation of the sliding or wiping operation of the upper and lower contacts 15 and 17. In this example, since a stopper 11*h* formed at the supporting piece 11*g* of the yoke 11 is vertically positioned at the outer portion of the armature 13, it abuts the outer surface of the armature 13 to prevent the armature 13 from falling off toward the outer direction of the yoke. Further, the armature 13 is prevented from falling off toward the upper direction of the yoke 11 due to the tensioning of the spring 18.

Figure 9:
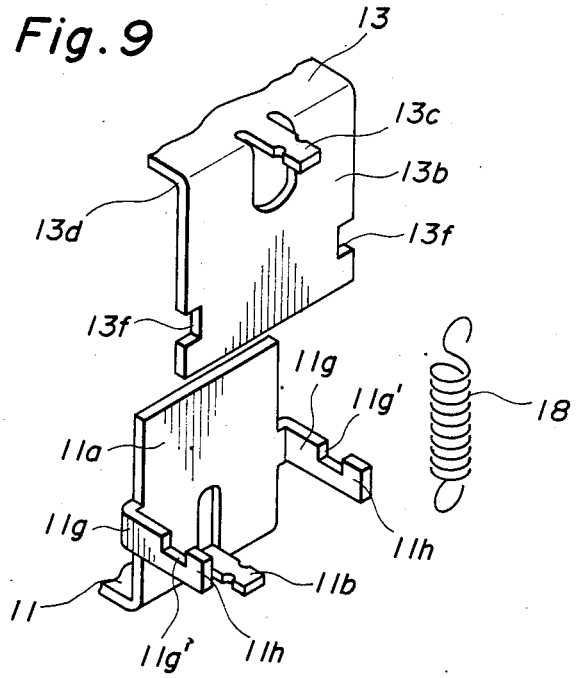
FIG. 9 is a perspective exploded view of a fourth embodiment of the invention.

FIG. 9 is an illustrative view of a material portion of the hinge type relay of a fourth embodiment of the present invention. In this embodiment, the latching hole 13*e* in the rocking cardinal piece of the armature 13 of the third example is omitted and a cutaway portion 13*f* for rockingly insertion to the concave portion 11*g'* of the supporting piece 11*g* is provided at the lower part of the upper bent portion 11*a* of the yoke 11 at the left and right sides of the outer rocking cardinal piece 13. Other constructions are the same as the third embodiment and the armature 13 rocks permitting the inserting portion of the latching portion 13*e* of the rocking cardinal piece 13*b* and the concave portion 11*g'* of the supporting piece 11*g* of the yoke 11 to be a base point due to the excitation and the release of the electromagnet 12, whereby upper and lower changeover contacts 13 and 17 contact or separate each other causing the sliding or wiping effect.

What are claimed as new and desired to be secured by Letters Patent of the United States are:

1. A hinge type relay comprising:

a yoke having a yoke portion and a fulcrum portion connected to said yoke portion, an armature having a support portion and a rocking portion connected to and angled relative to said support portion, said fulcrum portion supporting said rocking portion for rocking motion thereon, a flexible member secured at one end to said support portion and having a contact member at another end, an electromagnetic coil positioned for magnetically attracting said support portion theretowards and a fixed contact positoned so that said contact member contacts it when said support portion is magnetically attracted towards said coil and said rocking portion rocks on said fulcrum portion, and said flexible member bending and said contact member sliding on said fixed contact as said support portion is drawn closer to said coil.

2. The relay of claim 1 including, a biasing means connected to said armature for biasing said contact member away from said fixed contact.

3. The relay of claim 2 including, said armature having a projection arm, said biasing means including a spring having one end connected to said projection arm at a projection arm location, and said fulcrum portion being positoned between said projection arm location and said contact member.

4. The relay of claim 3 including, said yoke including a lower projection arm, and said spring having a second end attached to said lower projection arm.

5. The relay of claim 1 including, a fixing means or fixing said flexible member to said support portion.

6. The relay of claim 5 including, said fixing means including said flexible member including two openings, and said support portion including two buttons positioned in said openings.

7. The relay of claim 1 including, said fulcrum portion defining a cradle in which said fulcrum portion rocks.

8. The relay of claim 7 including, said support portion being positioned between said cradle and said contact member.

9. The relay of claim 1 including, said contact member rotating on and traveling along said fixed contact away from said rocking portion as said armature portion is drawn towards said coil.

10. The relay of claim 1 including, said yoke portion and said fulcrum portion being formed from a single piece.

11. The relay of claim 10 including, said fulcrum portion comprising a laterally extending arm which is formed by being bent upwardly a then inwardly.

12. The relay of claim 1 including, said fulcrum portion comprising an arm extending laterally and outwardly relative to said yoke portion.

13. The relay of claim 12 including, said arm having an indent on its upper surface, and said rocking portion resting in said indent.

14. The relay of claim 13 including, said rocking portion having an opening, said arm passing through said opening, and said opening having an upper surface resting in said indent.

15. The relay of claim 13 including, said rocking portion having on a lower surface thereof, a downwardly depending notch resting in said indent.

16. The relay of claim 1 including, said fulcrum portion comprising an arm extending away from said contact member, and said arm having a stopper member, and a support surface on which said rocking portion rests and positioned between said stopper member and said yoke portion.

17. The relay of claim 1 including, said rockng portion being formed at a right angle relative to said support portion.

18. The relay of claim 1 including, said yoke having a yoke base portion to which said coil is mounted.

19. The relay of claim 1 including, said armature portion being disposed above said coil.

20. The relay of claim 1 including, an upper contact point fixed in spaced relation above said fixed contact and which said contact member engages when in an upper rocking position.

21. The relay of claim 20 including, said contact member when in an upper rocking position sliding along the surface of said upper contact point.

22. The relay of claim 1 including, said yoke portion being generally vertically disposed, and said fulcrum poriton being formed at an upper portion of said yoke portion and bent relative thereto.

23. The relay of claim 1 including, said flexible member one end, and said another end being positoned in the same plane perpendicular to the longitudinal axis of said electromagnetic coil.

24. The relay of claim 1 including, said fixed contact being disposed in a direction generally parallel to the axis of said electromagnetic coil.

25. The relay of claim 1 including, said flexible member comprising a flat piece secured at said one end on top of said armature support portion.

* * * * *